US006205695B1

(12) United States Patent
Schnell

(10) Patent No.: US 6,205,695 B1
(45) Date of Patent: Mar. 27, 2001

(54) REMOVABLE TRIGGER LOCK FOR FIREARMS

(76) Inventor: Tim Schnell, 3708 Cobblestone Ct., Bedford, TX (US) 76021

( * ) Notice: Subject to any disclaimer, the term of this patent is extended or adjusted under 35 U.S.C. 154(b) by 0 days.

(21) Appl. No.: 09/410,143

(22) Filed: Sep. 30, 1999

(51) Int. Cl.[7] ..... F41A 17/00
(52) U.S. Cl. ..... 42/70.07; 42/70.11
(58) Field of Search ..... 42/70.07, 70.11

(56) References Cited

U.S. PATENT DOCUMENTS

| | | | | |
|---|---|---|---|---|
| 4,030,221 | | 6/1977 | Doobenen et al. | 42/1 Y |
| 4,499,681 | * | 2/1985 | Bako et al. | 42/70.07 |
| 4,509,281 | | 4/1985 | Dreiling et al. | 42/1 Y |
| 5,050,328 | * | 9/1991 | Insko | 42/70.07 |
| 5,054,222 | | 10/1991 | Hardy | 42/70.07 |
| 5,191,158 | | 3/1993 | Fuller et al. | 42/70.07 |
| 5,309,661 | * | 5/1994 | Fuller et al. | 42/70.07 |
| 5,437,119 | | 8/1995 | Womack | 42/70.07 |
| 5,515,633 | * | 5/1996 | Harris | 42/70.07 |
| 5,535,605 | * | 7/1996 | Werner | 70/70.07 |
| 5,560,135 | | 10/1996 | Ciluffo | 42/70.07 |
| 5,638,627 | * | 6/1997 | Klein et al. | 42/70.07 |
| 5,647,158 | * | 7/1997 | Eskelinen et al. | 42/70.07 |
| 5,704,152 | * | 1/1998 | Harrison et al. | 42/70.07 |
| 5,713,149 | | 2/1998 | Cady et al. | 42/70.06 |
| 5,778,586 | | 7/1998 | Carlson | 42/70.07 |
| 5,832,647 | * | 11/1998 | Ling et al. | 42/70.07 |
| 5,899,102 | * | 5/1999 | Ling | 42/70.07 |
| 5,918,402 | * | 7/1999 | Weinraub | 42/70.07 |
| 5,960,575 | | 10/1999 | Chiovitt et al. | 42/70.07 |

* cited by examiner

*Primary Examiner*—Charles T. Jordan
*Assistant Examiner*—Denise Buckley
(74) *Attorney, Agent, or Firm*—Schwegman, Lundberg,Woessner & Kluth, P.A.

(57) ABSTRACT

A removable trigger lock having a unitary housing that includes a first guard member and a second guard member permanently connected by a linking member having a fixedly sized gap therebetween for fitting the housing around the trigger lock section of a gun. The removable trigger lock has a lock member integrally and slidably coupled to the housing. The lock member has a open position such that it is not within the gap and an open position such that it is at least partially within the gap. The lock member has a shaft with a latching section for locking the shaft. The trigger lock includes a lock attached to the housing for locking the lock member into the second position. The locking mechanism is a combination lock.

17 Claims, 3 Drawing Sheets

REMOVABLE TRIGGER LOCK FOR FIREARMS

FIELD OF THE INVENTION

This invention relates to the field of firearms, and more specifically to removable trigger-blocking devices.

BACKGROUND OF THE INVENTION

Firearm users often need a device with which to lock or guard the trigger on their gun. Such devices can prevent children from being able to access the trigger on the gun and accidentally or purposely shooting the gun. The devices also prevent the trigger from unexpectedly being pulled while the gun is stored or jostled around.

In the past, trigger locks or trigger guards have been used to perform this purpose. These devices consist of at least two separate pieces which are placed on either side of the trigger of the gun and then locked together into fixed position. Most present firearm trigger locks and guard devices consist of a pair of guard pieces, a locking bar, and a key.

These devices have disadvantages. For instance, if any of the parts of the device is lost, the device cannot be used and must be totally replaced. Moreover, if a key is lost, the device cannot be opened in a emergency. Furthermore, some trigger guards are only designed for a certain size gun, such as a pistol, a rifle, or a shotgun.

Thus, there is a need for a removable trigger lock that has a minimal number of separate pieces, that can be opened without a key, and that can fit onto a variety of firearms.

SUMMARY OF THE INVENTION

The present invention provides a removable trigger lock including a one-piece housing having a gap for situating the housing around the trigger of a gun, a lock member integrally and slidably coupled to the housing, and a lock mechanism attached to the housing for locking the lock member into a position partially within the gap.

In further embodiments, the housing includes a first guard member and a second guard member connected by a linking member having a fixedly sized gap therebetween. The locking mechanism is a combination lock. In another embodiment, the lock member is U-shaped, having a first shaft with a latching section and a second shaft parallel to the first shaft.

The present invention provides a removable trigger lock that has a minimal number of removable, separate pieces so that it can be attached and removed from a gun without losing any parts. In one embodiment, the removable trigger lock includes a combination lock and therefore can be opened without a key, thus providing a complete one-piece mechanism. The present invention also provides a removable trigger lock that can interchangeably fit onto a variety of firearms.

DESCRIPTION OF PREFERRED EMBODIMENTS

In the following detailed description of the preferred embodiments, reference is made to the accompanying drawings that form a part hereof, and in which are shown by way of illustration specific embodiments in which the invention may be practiced. It is understood that other embodiments may be utilized and structural changes may be made without departing from the scope of the present invention.

The leading digit of reference numbers appearing in the Figures generally corresponds to the Figure number in which that component is first introduced, such that the same reference number is used throughout to refer to an identical component which appears in multiple Figures.

Figure 1:
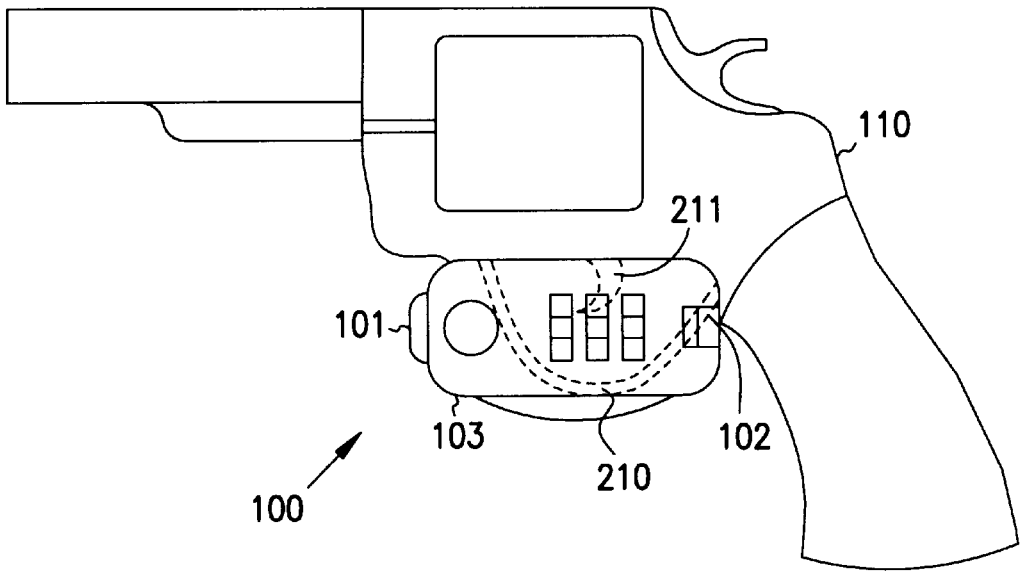
FIG. 1 shows one embodiment of a removable trigger lock attached to a gun.
Figure 2:
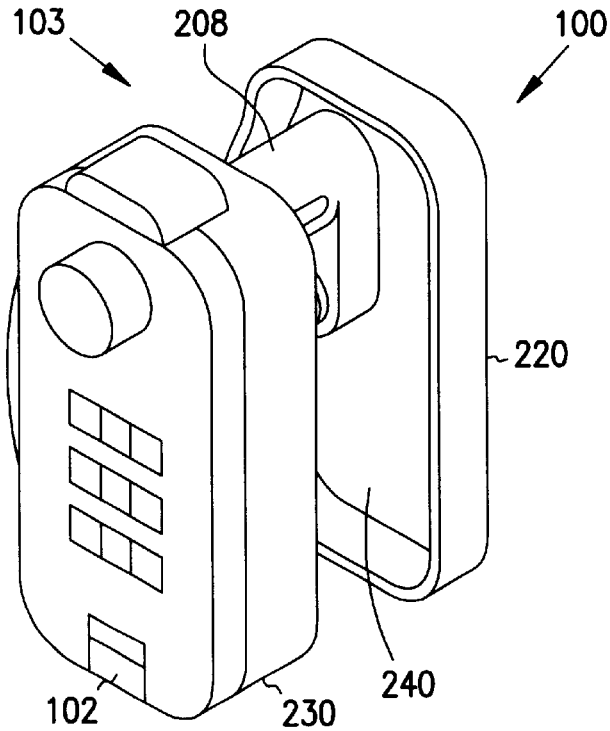
FIG. 2 shows an isometric view of the removable trigger lock of FIG. 1.

FIGS. 1–5 show an embodiment of a removable trigger lock 100 according to the present invention. FIG. 1 shows removable trigger lock 100 in position attached to an exemplary gun 110. As will be clear from the following description, trigger lock 100 can also be interchangeably used to block the access to the triggers on an assortment of guns such as rifles, shotguns, and/or pistols. Trigger lock includes a housing 103. Housing 103 has a one-piece, unitary structure when assembled, as shown in FIG. 2. Housing 103 has an approximate rectangle shape with a rounded portion disposed on one of its sides. The shape of removable trigger lock 100 and its rounded portion are adapted to cover and block access to a trigger 211 of gun 110. The shape is larger than the size of the gun's trigger guard section 210. In the present embodiment, the trigger lock is sized so that it will cover the trigger on a large gun such as a shotgun and also will cover the trigger of a relatively smaller gun such as a pistol without being excessively large.

Housing 103 includes an integral first guard member 220 and an integral second guard member 230. First guard member 220 and second guard member 230 are separated by a gap 240, which runs through a central section of housing 103. Gap 240 is sized to permit housing 103 to be disposed around trigger 211 so that first guard member 220 and second guard member 230 each block access to trigger 211 on the side they are disposed on.

First guard member 220 and second guard member 230 are connected by a linking member such as a crossbar 208 that permanently links the guard members after guard is assembled. In this embodiment, crossbar 208 has a hollow cylindrical shape and extends from first guard member 220 to second guard member 230 at an attaching hole 405. Removable trigger lock 100 can be assembled by attaching crossbar 208 to second member 230 by means of a threaded attachment, friction fitting, glue, or welding. Crossbar 208 provides a unitary structure for housing 103 while preventing the guard members 220 and 230 from coming apart. Alternatively, a linking member such as a hinge or other permanent connector can be used to connect guard members 220 and 230. This unitary structure allows removable trigger lock 100 to be disposed around the gun's trigger guard section 210 with crossbar 208 on the outside of trigger guard section 210 of the gun and a section of a lock post or lock member 201 on the inside of trigger guard section 210 of the gun. Removable trigger lock 100 can be attached to the gun without having to add or remove any pieces therefrom. The one-piece structure provides that no parts or members of trigger lock 100 can be misplaced when using the device.

Figure 4:
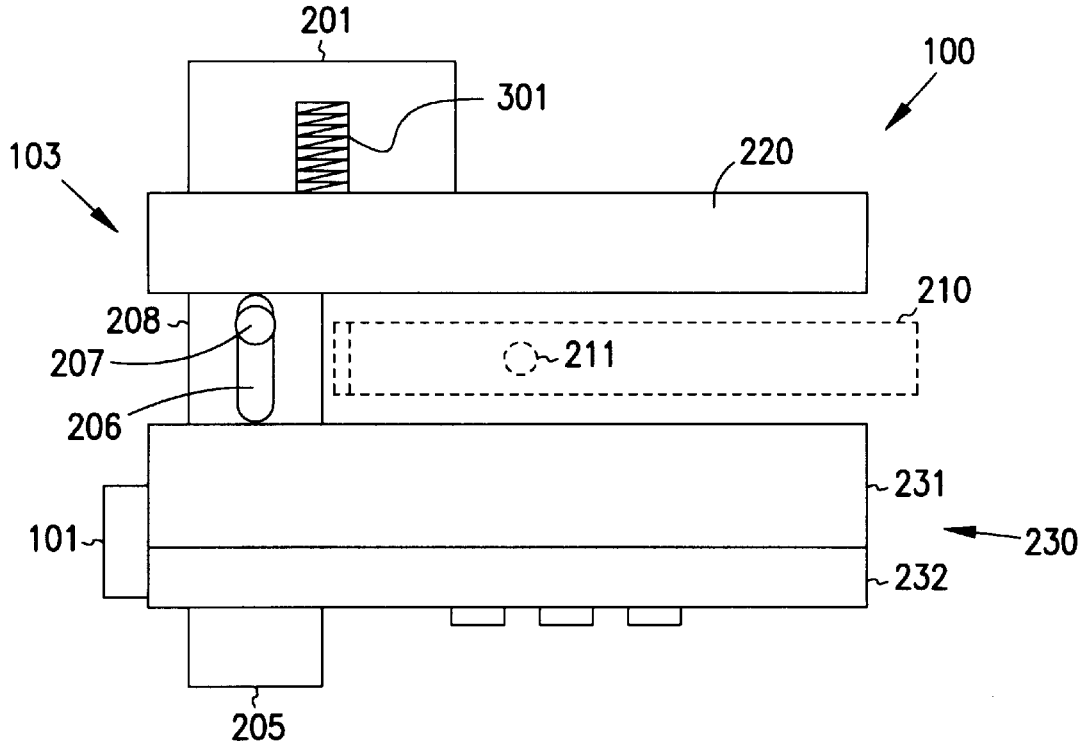
FIG. 4 shows a top view of FIG. 1 with the removable trigger lock in an open position.
Figure 5:
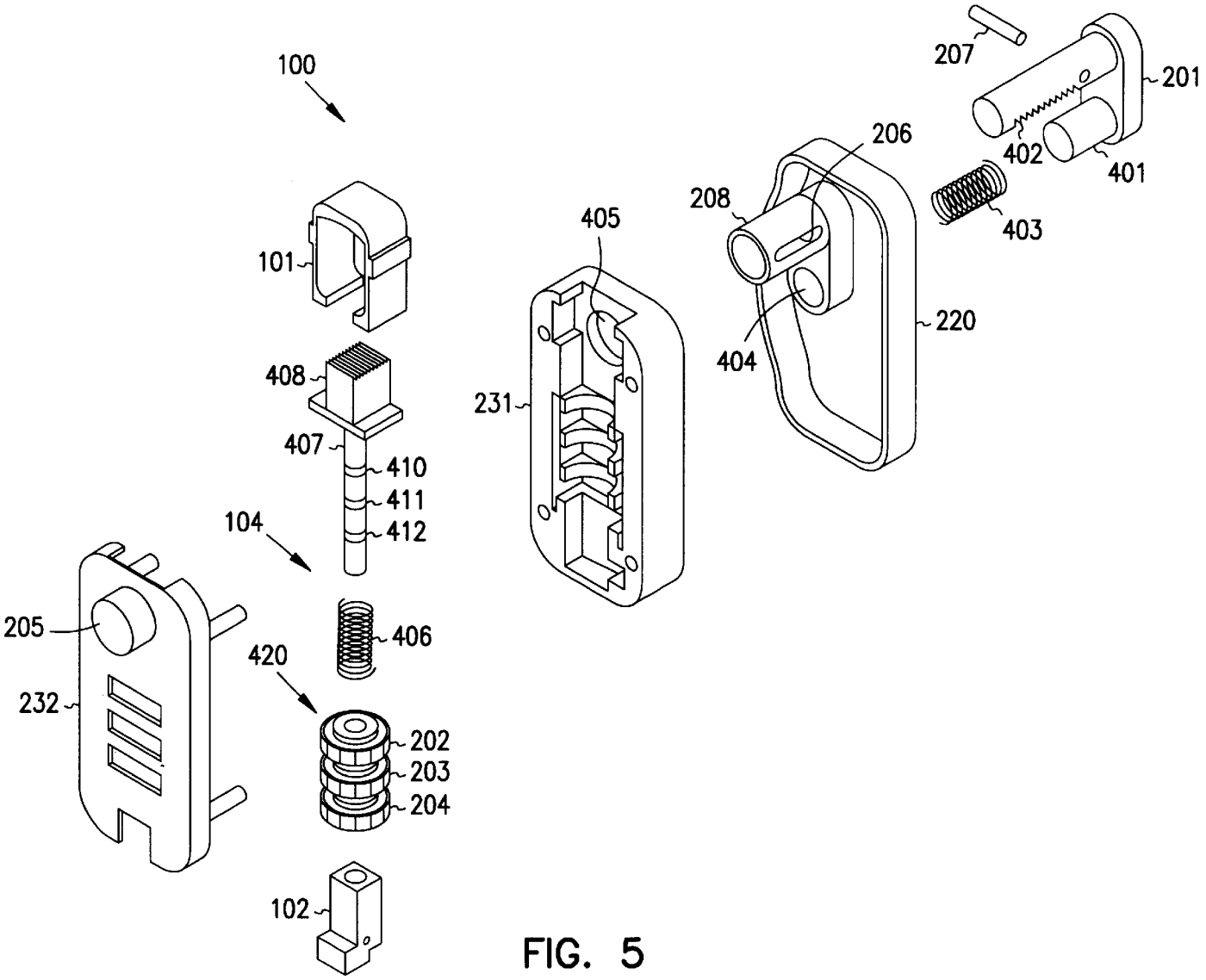
FIG. 5 shows an exploded view of the removable trigger lock of FIG. 1.

Removable trigger lock 100 also includes lock post or lock member 201. Lock member 201 is slidably situated within housing 103. As shown in FIG. 4, lock member 201 has a first, or open, position such that lock member 201 is not within gap 240. This permits housing 103 of removable trigger lock 100 to be freely removed from and/or positioned around gun trigger guard section 210. In this embodiment, lock member 201 is forced into the first, or open, position by a forcing means such as a spring 301, which is located between housing 103 and lock member 201.

Figure 3:
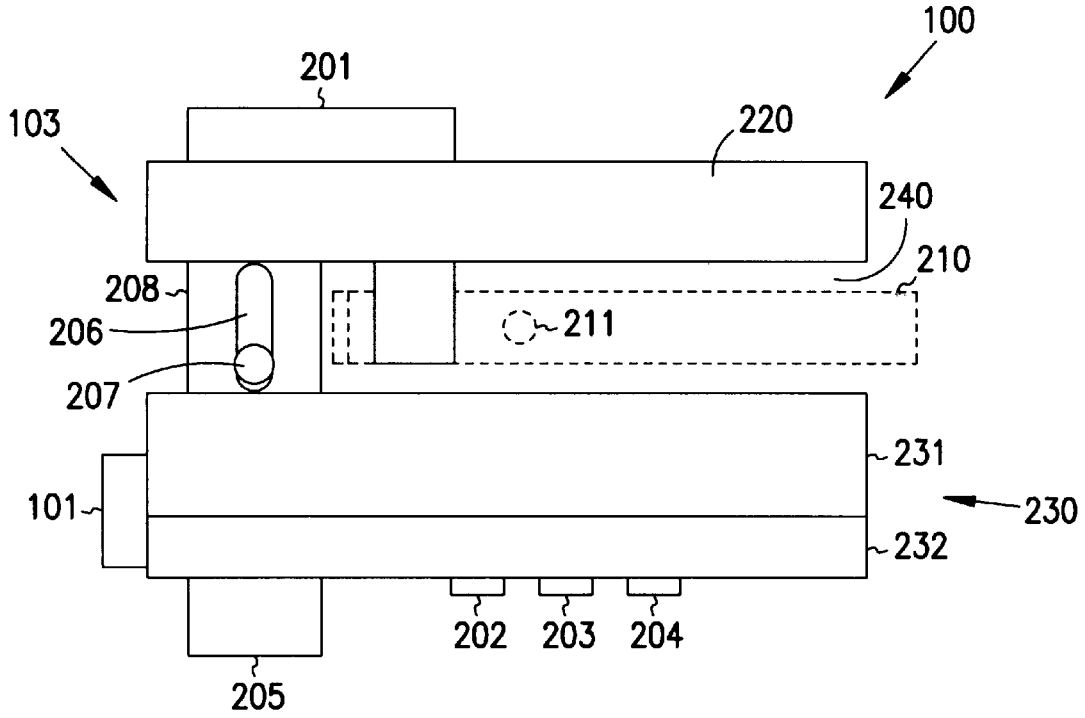
FIG. 3 shows a top view of FIG. 1 with the removable trigger lock in a closed position.

As shown in FIG. 3, lock member 201 has a second, or closed, position such that a portion of lock member 201 is at least partially within gap 240. When in this position, housing 103 remains firmly attached to gun 110 and cannot be pulled off in a direction along the length of the gun.

In this embodiment, lock member 201 is approximately U-shaped. It includes a first shaft 402 having a holding or locking section such as latching section 403 and a second shaft 401 which is slightly shorter than the first shaft. First shaft 402 is disposed to be slidably positioned within crossbar 208 while second shaft goes through a hole 404 in first guard member 220.

Linking member or crossbar 208 has a notch or slit 206 running down at least one side of the crossbar. A post 207 is attached to a section of first shaft 402. Post 207 is slightly longer than the diameter of crossbar 208 so that it catches against slit 206, causing lock member 201 to be retained in position within the crossbar. Those skilled in the art will recognize that other shapes for the lock member can be utilized as long as the lock member provides a locking function and is integrally coupled to the housing. Moreover, lock member 201 could be held in position by other catching means. For example, an outer retaining ring can be attached to an outer section of housing 103 to retain lock member 201 from falling out of the housing. The important thing is that the lock member forms an integral structure with the housing so that no parts of removable trigger lock 100 need be removed when attaching it or removing it from a gun.

Removable trigger lock 100 also includes a locking mechanism 104, such as a combination lock, attached to housing 103 for locking lock member 201 into the closed position. If a combination lock is employed, the complete trigger lock is a one-piece unit without a key that can be lost. Such a design greatly reduces the chances of rendering the trigger lock useless from the loss of only a part of it. Alternatively, the locking mechanism can include a key lock. This would mean that the unitary trigger lock 100 would only have to rely on one separate part that could get lost.

In this embodiment, locking mechanism 104 is a conventional combination lock sandwiched between a first section 231 and a second section 232 that comprise second guard member 230. Those skilled in the art will appreciate that many variations of combination locks can provide the same function of providing a locking mechanism that does not need a separate key.

Locking mechanism 104 includes a holding or latching section 408 for engaging with opposing lock member latching section 403 when lock member latching section 403 is pushed into contact with latching section 408. Locking mechanism 104 also includes a lockshaft 407 located beneath latching section 408. Lockshaft 407 includes three grooves 410–412 running around a surface of the lockshaft. A spring 406 is disposed around lockshaft 407 for forcing lockshaft 407 and latching section 408 in an axial direction against lock member latching section 403. A locking wheel mechanism 420 encircles lockshaft 407. Locking wheel mechanism 420 includes three combination indexing wheels 202–204. Each indexing wheel 202–204 needs to be turned to a correct number for lockshaft 407 to become disengaged from within locking wheel mechanism 420. A set/release button 102 is disposed under locking wheel mechanism 420. When set/release button 102 is pressed the user can turn index wheels 202–204 to their proper positions. When not pressed, set release button 102 keeps pressure on the wheels so that they will not turn unexpectedly.

A latch releasing means such as a button 101 is also slidably disposed within housing 103. Button 101 is adapted for releasing lock member 201 from the closed position to the open position. When locking mechanism 104 is in a locked state, button 101 cannot be depressed and the trigger guard 100 stays in a locked position. When locking mechanism 104 is in an unlocked state, button 101 can be depressed. This forces latching section 408 to disengage from lock member latching section 403. Spring 301 forces lock member 201 out of gap 240 and removable trigger lock 100 can be removed from the gun. This provides that even if the locking mechanism 104 is unlocked, the lock member 201 will not spring loose into an open position until button 101 is pushed. This allows the trigger lock 100 to be grasped firmly before it is released from its locked position so that it will not be lost or dropped while releasing it.

Second section 232 of second guard member 230 includes a cavity 205 for receiving a portion of first shaft 402 when it is in the closed position. Second section also includes three slits for exposing indexing wheels 202–204 so that a user has access to them to unlock the trigger lock.

To put removable trigger lock 100 onto a gun, a user opens it to an open position as shown in FIG. 4 by pushing button 101. The device is then placed around the trigger guard section 210 of the gun as shown in FIG. 1. The user then presses on the outer end of lock member 201 until second shaft 401 is substantially within gap 240 and latching section 403 of first shaft 402 has become engaged with the latching section 408 of lock mechanism 104, as shown in FIG. 3. To remove removable trigger lock 100, the user dials the combination of the lock mechanism and then depresses button 101. Spring 301 forces lock member 201 into an open position, and the device can be removed from around the trigger guard section of the gun.

The present invention provides a removable trigger lock that has a minimal number of removably separate pieces that need to be attached and/or removed from a gun. In one embodiment, the removable trigger lock includes a combination lock and therefore can be opened without a key, thus providing a one-piece mechanism. The present invention also provides a removable trigger lock that can interchangeably fit onto a variety of firearms.

It is understood that the above description is intended to be illustrative, and not restrictive. Many other embodiments will be apparent to those of skill in the art upon reviewing the above description. The scope of the invention should, therefore, be determined with reference to the appended claims, along with the full scope of equivalents to which such claims are entitled.

What is claimed is:

1. A trigger lock for a firearm, the trigger lock comprising:

a pair of guard members permanently coupled by a crossbar;

a U-shaped lock member having a first leg and a second leg, the first leg slidable within the crossbar, the second leg slidable across a gap between the pair of guard members; and a lock mechanism for locking the lock member into place on the firearm.

2. The trigger lock of claim 1, further comprising a button coupled to the housing for releasing the lock member, wherein, when the lock is unlocked, the lock member remains in position until the button is pushed.

3. A trigger lock for blocking access to the trigger of a gun, the trigger lock comprising:

a housing having a fixedly sized gap for receiving a trigger guard of the gun;

lock member slidably coupled to the housing; and a mechanical lock mechanism for locking the lock member within the gap so that the housing is locked to the gun, wherein the lock member comprises a U-shaped member, the lock member having a first shaft with a latching section for engaging with the lock mechanism.

4. The trigger lock of claim 3, wherein the housing comprises a pair of guard members connected by a linking member.

5. The trigger lock of claim 4, wherein each of the pair of guard members include a rounded portion along a side of the guard member for covering substantially all of the trigger guard of the gun.

6. The trigger lock of claim 3, further comprising a spring means for forcing the lock member into a position out of the gap when the mechanical lock mechanism is unlocked.

7. The trigger lock of claim 3, wherein the locking mechanism includes a locking mechanism latching section for engaging the latching section of the lock member.

8. A trigger lock for blocking access to the trigger of a gun, the trigger lock comprising:

a housing having a fixedly sized gap for receiving a trigger guard of the gun;

a lock member slidably coupled to the housing;

a mechanical locking mechanism for locking the lock member within the gap so that the one-piece housing is locked to the gun; and a button coupled to the locking mechanism, the button for releasing the lock member from a closed position to an open position;

wherein, when the locking mechanism is in an open position the button can be depressed, and when the locking mechanism is in a locked position the button cannot be depressed.

9. The trigger lock of claim 8, wherein the mechanical locking mechanism comprises a combination lock.

10. A removable trigger lock for a firearm, the trigger lock comprising:

a unitary housing;

a lock mechanism attached to the unitary housing, the lock mechanism includes a latching section;

a U-shaped lock member slidably coupled to the unitary housing for locking the housing onto the firearm, the lock member having a shaft with a latching section for engaging with the lock member latching section; and a button coupled to the locking mechanism, the button for releasing the lock member from a closed position to an open position;

wherein, when the locking mechanism is in an open position the button can be depressed, and when the locking mechanism is in a locked position the button cannot be depressed.

11. A trigger lock for a firearm, the trigger lock comprising:

a unitary housing having a first guard member and a second guard member permanently connected to each other;

a lock mechanism attached to the unitary housing; and a lock member for positively engaging the first guard member and the second guard member when the lock member is engaged with the lock mechanism, wherein the lock member comprises a U-shaped member having a first shaft, a second shaft, and an outer end, the outer end positively engages the first guard member when the lock member is engaged with the lock mechanism.

12. The trigger lock of claim 11, wherein the lock member includes a latching section and the lock mechanism includes an opposing latching section for engaging with the lock member latching section.

13. A trigger lock for a firearm, the trigger lock comprising:

a unitary housing having a first guard member and a second guard member;

a lock mechanism attached to the second guard member; and a lock member slidably coupled to the first guard member, the lock member having a first shaft and a second shaft, the first shaft located inside a trigger guard of the firearm and the second shaft located outside the trigger guard when the lock member is in a closed position on the firearm, wherein the lock member comprises a U-shaped member having an outer end for engaging the first guard member when the lock member is in the closed position.

14. The trigger lock of claim 13, wherein when the trigger lock is locked onto the firearm, the lock member engages the lock mechanism and also engages the first guard member so as to prevent the first guard member and the second guard member from being pulled apart from each other.

15. The trigger lock of claim 13, wherein the unitary housing further comprises a crossbar connecting the first guard member and the second guard member.

16. The trigger lock of claim 15, wherein the lock member first shaft is slidably mounted within the crossbar, the first shaft having a latching section which engages with the lock mechanism.

17. The trigger lock of claim 13, wherein the lock mechanism comprises a combination lock.

* * * * *

UNITED STATES PATENT AND TRADEMARK OFFICE

CERTIFICATE OF CORRECTION

PATENT NO. : 6,205,695 B1
DATED : March 27, 2001
INVENTOR(S) : Schnell

It is certified that error appears in the above-identified patent and that said Letters Patent is hereby corrected as shown below:

Column 5, claim 3,
Line 9, delete "lock member" and insert -- a lock member --, therefor.

Signed and Sealed this

Twenty-seventh Day of November, 2001

*Attest:*

Nicholas P. Godici

NICHOLAS P. GODICI
*Acting Director of the United States Patent and Trademark Office*

*Attesting Officer*